United States Patent [19]

Werner

[11] Patent Number: 4,998,886

[45] Date of Patent: Mar. 12, 1991

[54] HIGH DENSITY STACKING CONNECTOR

[75] Inventor: Oskar O. Werner, Leucadia, Calif.

[73] Assignee: Teledyne Kinetics, Solana Beach, Calif.

[21] Appl. No.: 376,522

[22] Filed: Jul. 7, 1989

[51] Int. Cl.[5] ..... H01R 9/09

[52] U.S. Cl. ..... 439/66; 439/65; 439/631

[58] Field of Search ..... 439/66, 71, 74, 75, 439/65, 91, 591, 592, 631

[56] References Cited

U.S. PATENT DOCUMENTS

| | | | |
|---|---|---|---|
| 3,140,907 | 7/1964 | Davies . | |
| 3,173,732 | 3/1965 | James . | |
| 3,215,968 | 11/1965 | Herrmann . | |
| 3,518,612 | 6/1970 | Dunman et al. . | |
| 3,795,037 | 3/1974 | Luttmer | 439/591 X |
| 3,795,884 | 3/1974 | Kotaka . | |
| 3,858,154 | 12/1974 | William . | |
| 3,858,961 | 1/1975 | Goodman et al. . | |
| 3,960,424 | 6/1976 | Weisenburger . | |
| 4,003,621 | 1/1977 | Lamp | 439/591 |
| 4,204,205 | 5/1980 | Yagi et al. | 439/66 |
| 4,295,730 | 10/1981 | Sado . | |
| 4,402,562 | 9/1983 | Sado . | |
| 4,445,735 | 5/1984 | Bonnefoy | 439/591 X |
| 4,508,398 | 4/1985 | Stepan et al. . | |
| 4,575,175 | 3/1986 | Wilson . | |
| 4,577,922 | 3/1986 | Stipanuk et al. | 439/629 |
| 4,699,593 | 10/1987 | Grabbe et al. | 439/71 |
| 4,715,820 | 12/1987 | Andrews, Jr. et al. | 439/59 |
| 4,738,625 | 4/1988 | Burton et al. | 439/59 |
| 4,894,022 | 1/1990 | Guckenheimer | 439/260 |
| 9,829,817 | 8/1974 | Beavitt . | |

OTHER PUBLICATIONS

Leonard Buchoff, PCK Elastomerics, Inc., Guidelines for Designing Elastomeric Connectors Into the System, Connection Technology, Aug. 1987.

Advertisement of Connection Technology, Interposer Multichip Socket, Copyright, 1988.

AMP Inc., Contact Systems, Connection Technology, Dec. 1988, p. 44.

Advertisement of PCK Elastomerics, Inc., Carbon Stax Elastomeric Connectors.

*Primary Examiner*—Neil Abrams
*Assistant Examiner*—Khiem Nguyen
*Attorney, Agent, or Firm*—Nydegger & Associates

[57] ABSTRACT

An electrical connector includes a plurality of elongated electrically conductive contacts which are arranged in a side-by-side relationship to establish a first row of end points which is substantially parallel to a second row of end points. A plurality of dielectric insulators are provided and are respectively positioned between the contacts to electrically isolate the individual contacts from each other. Additionally, the contacts are flexible to permit relative movement between end points on the first row and end points on the second row. The combination of stacked contacts and isolating insulators are held on a base to complete a plurality of electrical connections between circuits engaged with end points on the first row and circuits engaged with end points on the second row.

20 Claims, 3 Drawing Sheets

Fig. 1
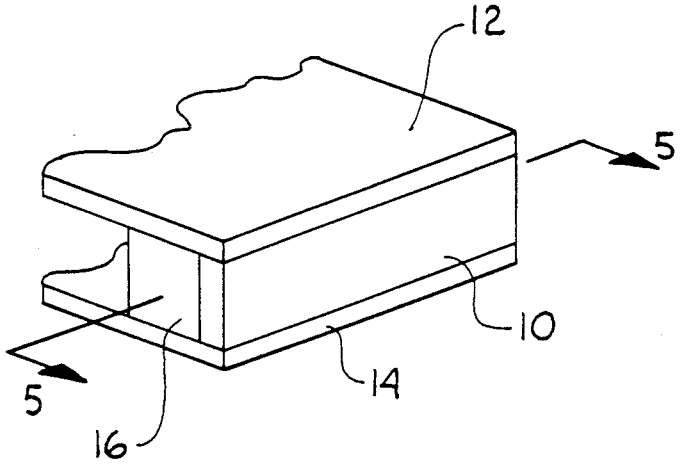
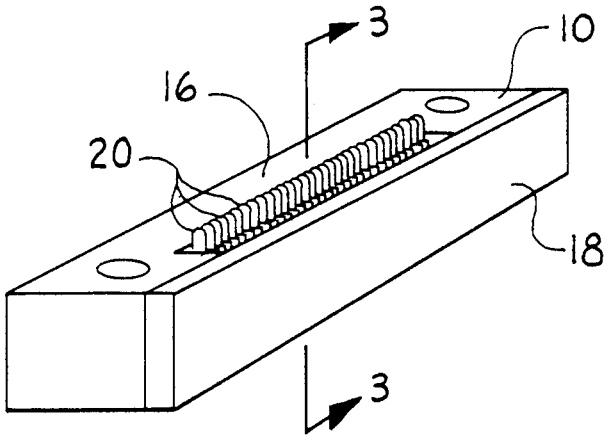
Fig. 2
Fig. 3
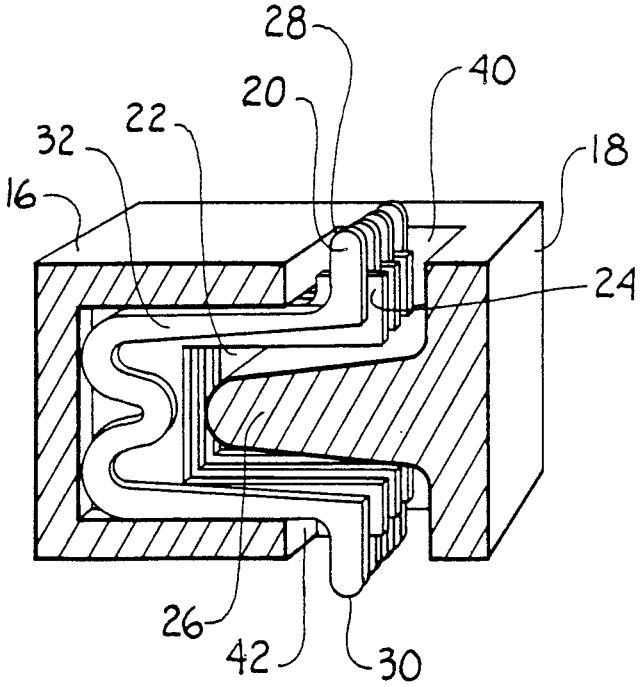

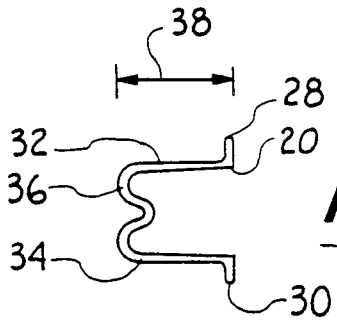
Fig. 4A
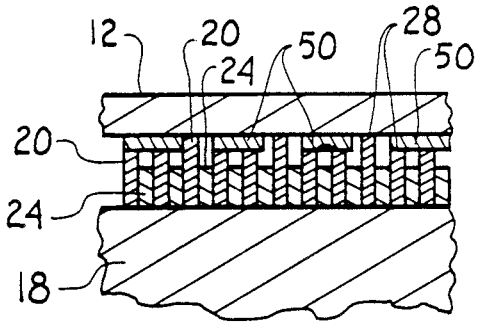
Fig. 5
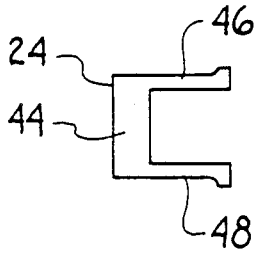
Fig. 4B
Fig. 6
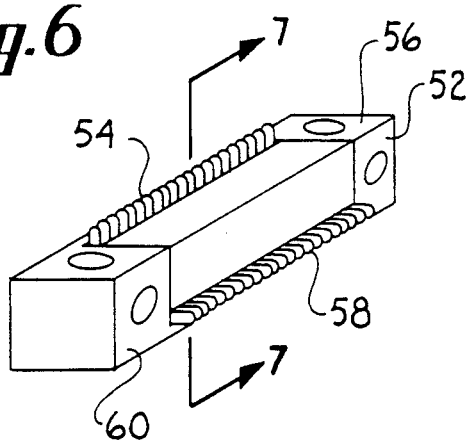
Fig. 7
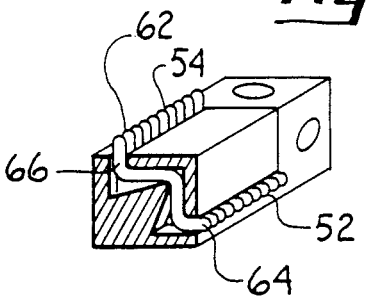
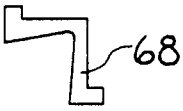
Fig. 8B
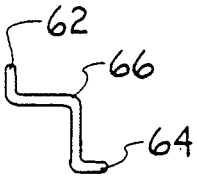
Fig. 8A Fig. 9
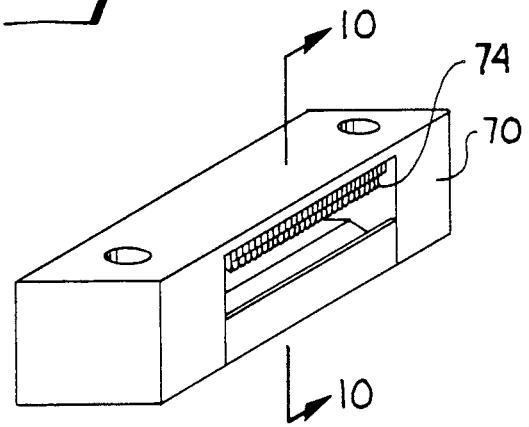
Fig. 10
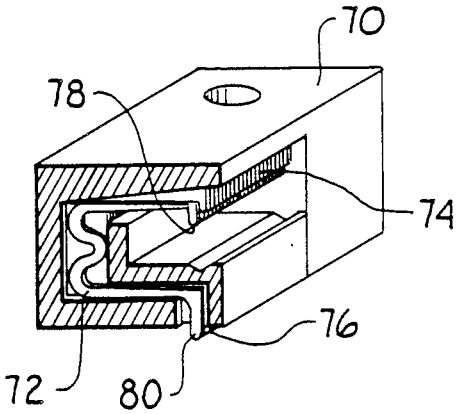
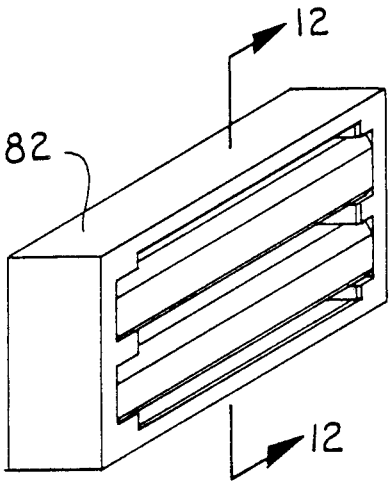
Fig. 11
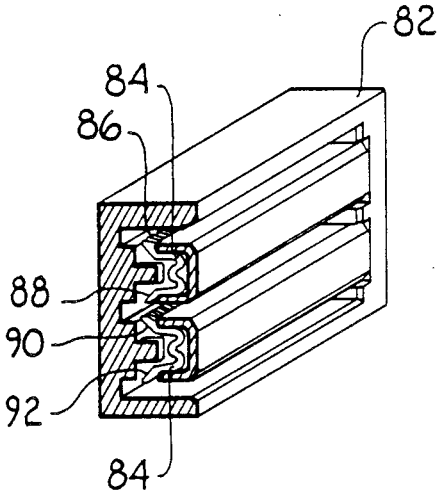
Fig. 12

HIGH DENSITY STACKING CONNECTOR

FIELD OF THE INVENTION

The present invention pertains generally to electrical connectors. More specifically, the present invention relates to electrical connectors which are useful for simultaneously completing a plurality of electrical circuits. This invention is particularly, but not exclusively, useful for completing circuits between a printed circuit mother board and a printed circuit daughter board.

BACKGROUND OF THE INVENTION

Numerous devices have been proposed which are designed and intended to connect various components into functional electronic circuits. Of particular importance here are electrical connectors which are specifically engineered to join printed circuit boards together. It is not surprising that as electrical circuits have become more complicated and sophisticated, the connectors which join various components of these circuits have also become more complicated and sophisticated. Unfortunately, however, it has happened that although the circuitry on printed circuit boards can be effectively miniaturized using state-of-the-art technology, connector technology has not kept pace. This is so for several reasons. First, there are problems with proper registry of the connector with the various circuits on the printed circuit board. Second, there is the ever present problem of establishing and maintaining a reliable and robust electrical contact.

As for the registration problem, several connectors have been disclosed which are engineered with the intent of providing accurate alignment and positioning of the connector contact with the appropriate circuits. It will be easily appreciated, however, that as the particular circuits are made smaller and smaller, the ability to properly and accurately register the connector contact with the desired circuit becomes more difficult. Unfortunately, this difficulty is aggravated as the number of circuits is increased and their proximity to each other is decreased. Presently, it is not uncommon for printed circuit boards to be printed with different circuits as close to each other as fifty thousandths (0.050) of an inch from some center to center printed circuits, however, are being manufactured where the distance between centers is on the order of twenty-five thousandths (0.025) of an inch. Nevertheless, a twenty-five thousandths-inch spacing between the centers of electrical contact points can present very profound problems when there are as many as one hundred (100) or two hundred (200) circuits involved. Further, there are increased difficulties in manufacturing connectors as they are made smaller and smaller to accommodate the smaller more closely positioned printed circuits.

One proposed solution has been to provide a housing module which precisely spaces the connectors and combines them into a unit. Such a housing is also keyed with the circuit board to accurately position the connector against the proper circuit on the circuit board. To do this, however, requires precision manufacturing and, consequently, involves increased costs. U.S. Pat. No. 4,715,820 to Andrews, Jr. et al. is an example of such a device.

Another solution to the registration problem is provided by the so-called elastomeric connectors. Typically, such connectors consist of carbon impregnated layers of silicone which are separated by nonconductive silicone layers. The elastomeric connectors typically have very many layers which are arranged in a side-by-side relationship and which can each be as narrow as approximately two thousandths (0.002) of an inch. Thus, they alleviate the registration problem by providing a plurality of possible electrical connections for each printed circuit pad, even though these pads may be separated from one another by as little as twenty-five thousandths (0.025) of an inch. Elastomeric connectors, however, are bound together in a matrix so that the deflection of a conductive layer is directly affected by the position of its adjacent layers. Thus, depending on irregularities in the pads of the printed circuit boards, it can happen that conductive layers are held off their intended mating pads by surrounding higher pads. Further, elastomeric connectors are typically flexible and will, therefore, not reliably develop the higher contact pressures which are needed to insure a proper electrical connection. Stated differently, elastomeric connectors do not reliably establish low interfacial resistance. Accordingly, their utility for logic circuits can be questionable. An example of an elastomeric connector is the product manufactured by PCK Elastomerics, Inc. and known commercially as "Carbon Stax".

The present invention recognizes that a connector can be manufactured which develops the pressure between contact and printed circuit pad required to insure low interfacial resistance, but which does not require keyed registration to insure proper connection between the various electronic components. The present invention also recognizes that metallic contacts can be effectively juxtaposed to provide a high contact density connector without compounding machine tolerance errors.

In light of the above, it is an object of the present invention to provide a high density stacked electrical connector which establishes a good electrical contact between connected electrical components for high density current flow. Yet another object of the present invention is to provide a high density stacked electrical connector which has low interfacial resistance between the connected electrical components. Still another object of the present invention is to provide a high density stacked electrical connector which provides a reliable and predictable means for achieving proper registration between the connected electrical components. Another object of the present invention is to provide a high density stacked electrical connector which obviates the tolerance problems typically associated when aligning a printed circuit board with the connector. Yet another object of the present invention is to provide a high density stacked electrical connector which is rugged and establishes a robust connection for electrical components. Still another object of the present invention is to provide a high density stacked electrical connector which is relatively easy to manufacture and comparatively cost-effective.

SUMMARY OF THE INVENTION

An electrical connector in accordance with the present invention comprises a nonconductive base which is formed with a channel or cavity. A plurality of electrically conductive contacts are provided which are preferably made of a metal such as a beryllium copper alloy. For use in the present invention, each contact is a unitary elongated member which has a body portion that is bent, molded, stamped, or somehow formed into a predetermined shape. Further, each contact has a first end point and a second end point which, due to the bent or preformed configuration of the contact, are able to move relative to each other against the spring-like resistance of the body portion of the contact. A plurality of dielectric insulators are provided and are individually positioned between the contacts to electrically isolate the contacts from each other. Together, the stacked combination of alternating contacts and insulators establishes a strip which is positionable within the cavity of the base.

When the strip is positioned in the cavity of the base, the first end points of the various contacts are aligned as a row of contact points. Also, the second end points of these same contacts are aligned as a row of contact points which is substantially parallel to the row of first end points. Thus, the electrical connector of the present invention provides mutually parallel rows of contact points. Importantly, both the contacts and the insulators are sufficiently thin to establish rows of contact points wherein the distance between the points is approximately less than ten thousandths (0.010) of an inch. Consequently, when this connector is mated against printed circuit boards that have pads which are distanced approximately twenty-five thousandths of an inch (0.025) between their centers, at least one (1), and possibly two (2), contacts are pressed against a pad.

The novel features of this invention, as well as the invention itself, both as to its structure and its operation, will be best understood from the accompanying drawings, taken in conjunction with the accompanying description, in which similar reference characters refer to similar parts, and in which:

BRIEF DESCRIPTION OF THE DRAWINGS

FIG. 1 is a perspective view of a high density connector according to the present invention in contact with a pair of printed circuit boards;

FIG. 2 is a perspective view of the high density connector shown in FIG. 1;

FIG. 3 is a cross-sectional view of the high density connector as seen along the line 3—3 in FIG. 2;

FIG. 4A is an elevational side view of a contact for use with the connector shown in FIG. 2;

FIG. 4B is an elevational side view of an insulator for use with the connector shown in FIG. 2;

FIG. 5 is an enlarged, partial cross-sectional view of the connection between a connector and a printed circuit board as would be seen along the line 5—5 in FIG. 1;

FIG. 6 is a perspective view of an alternate embodiment of a connector;

FIG. 7 is a perspective, cross-sectional view of the connector as seen along the line 7—7 in FIG. 6;

FIG. 8A is an elevational side view of a contact for use with the connector shown in FIG. 6;

FIG. 8B is an elevational side view of an insulator for use with the connector shown in FIG. 6;

FIG. 9 is a perspective view of another embodiment of a connector according to the present invention;

FIG. 10 is a cross-sectional view of the connector as seen along the line 10-10 in FIG. 9;

FIG. 11 is a perspective view of another embodiment of a connector in accordance with the present invention; and FIG. 12 is a cross-sectional view of the connector as seen along the line 12—12 in FIG. 11.

DESCRIPTION OF THE PREFERRED EMBODIMENT

Referring initially to FIG. 1, a high density electrical connector 10, is shown in a position to interconnect a mother printed circuit board 12 with a daughter printed circuit board 14. More specifically, as perhaps best seen in FIG. 2, the connector 10 comprises a base 16 which acts together with a cover plate 18 to hold a series of contacts 20 in an aligned side-by-side relationship. The cross-sectional view of FIG. 3 shows that base 16 is formed with a channel-like cavity 22 into which a row of juxtaposed contacts may be placed to establish a strip of contacts. As also seen in FIG. 3, a plurality of insulators 24 are interposed between the contacts 20 to electrically isolate each contact 20 from its adjacent contact 20.

FIG. 3 also shows that cover plate 18 is formed with an extension 26 which inserts into cavity 22 and holds contacts 20 and insulators 24 in the cavity 22 when cover plate 18 is engaged with base 16. As will be appreciated by the skilled artisan, cover plate 18 may be attached to base 16 by any means well known in the art, such as by solvent bonding. For purposes of the present invention, both cover plate 18 and base 16 are made of a dielectric material such as plastic.

The structure of contact 20 is best seen in FIG. 4A where it will be appreciated that the contact 20 is a generally W-shaped elongated member having a first contact end point 28 and a second contact end point 30. Intermediate end points 28 and 30, the body portion of contact 20 is bent or preformed to establish a spring-like structure which has a cantilever 32 and a cantilever 34 that each extend from a support portion 36. It should be noted that, in order for connector 10 to be compact, the length 38 of cantilevers 32 and 34 should be as short as possible. Length 38 must, however, allow sufficient flexure of the cantilevers 32 and 34 in order for there to be movement of the end points 28 and 30 relative to support portion 36. Accordingly, when the contacts 20 are held in cavity 22 of base 16 by cover plate 18, as substantially shown in FIG. 3, the end points 28 of contacts 20 can be pushed into the slot 40 which is formed between base 16 and cover plate 18. When so pushed, the contact 20 is stressed and end point 28 is urged by the spring action bias of cantilever 32 in a direction out of the slot 40. Similarly, as shown in FIG. 3, end point 30 of contact 20 extends from slot 42 when cantilever 34 is unstressed. Further, contact point 30 is urged to continue extending from slot 42 by the spring action of contact 20 whenever it is pushed into slot 42 against this spring action. Subsequently, it will be more fully appreciated that the flexibility of the contact 20 and the bias which urges end points 28, 30 toward their unstressed positions is provided to insure good electrical contact between the connector 10 and the printed circuit boards 12, 14. Preferably, contact 20 is made of a conductive metal such as a beryllium copper alloy.

The insulator 24 shown in FIG. 4B is illustrative of the shape which can be used to electrically isolate the contacts 20 from each other. Specifically, as shown, insulator 24 has a base portion 44 and arms 46 and 48 which extend from the base portion 44 to respectively abut base portion 36 and cantilever 32 and 34 when insulator 24 is placed in juxtaposition between any two contacts 20.

The actual electrical connection between a printed circuit board 12 and the connector 10, will be best seen in FIG. 5. As shown in FIG. 5, printed circuit board 12 has a plurality of electrical circuit pads 50 which are each part of separate electrical components (not shown). As intended by the present invention these components are to be electrically connected with yet other components (also not shown) on printed circuit board 14. Connector 10 provides this connection. Specifically, the contacts 20 are juxtaposed to establish a row of aligned end points 28 which is placed in contact with printed circuit board 12. The spacing between contacts 20 is such that, within the distance from a particular position on one pad 50 to a like position on adjacent pad 50, there will be several contact points 28. Specifically, each contact 20 and each insulator 24 can be manufactured to be approximately five thousandths (0.005) inch thick. Thus, if the pads 50 are separated by approximately twenty five thousandths (0.025) inches between their centers, there will be some overlap (i.e., on average, there will be more than one contact 20 per pad 50). Indeed, there will by an average of more than one and a half contacts 20 per pad 50. The distance between centers of pads 50 may, of course, be greater than twenty five thousandths (0.025) of an inch, and the thickness of the contacts 20 may be less five thousandths (0.005) inch. In any event, as shown in FIG. 5, spacings of this magnitude insure that at least one contact point 28 is touching any particular pad 50. Accordingly, each pad 50 with its respective contact (or contacts) 20 establish an electrical path with which an appropriate pad (not shown) on printed circuit board 14 can be connected to complete an electrical circuit.

FIG. 6 shows an embodiment for a connector which is more suitable for use with perpendicularly mounted printed circuit boards (not shown) rather than for use with boards mounted in parallel such as are the printed circuit boards 12 and 14 shown connected by connector 10 in FIG. 1. Specifically, connector 52 has a row 54 of contact points which extends from side 56 of connector 52 and a row 58 of contact points which is substantially parallel to row 54 but which extend from side 60 of the connector 52. As shown, side 56 is oriented substantially perpendicular to side 60 to accommodate perpendicularly mounted printed circuit boards. FIG. 7 shows that rows 54 and 58 are established by the respective end points 62 and 64 of individual contacts 66. Further, contact 66 is shaped to provide a spring like action in response to any bending which will urge end points 62 and 64 toward their unstressed relationships shown in FIG. 7 and FIG. 8A. The insulator 68 shown in FIG. 8B is compatibly shaped for contact 66 and serves the same purpose as disclosed above for insulator 24 relative to contact 20.

FIG. 9 and FIG. 10 show a connector 70 which holds a plurality of aligned connectors 72 that together present rows 74 and 76 of respective end points 78 and 80 for appropriate connection with mother and daughter printed circuit boards (not shown). Such a configuration is disclosed in much greater detail in U.S. Pat. No. 4,185,882 which is assigned to the same assignee as the present invention. Similarly, FIG. 11 and FIG. 12 show another connector 82 which is intended to hold two strips of contacts 84. With the configuration of connector 82, the four rows 86, 88, 90 and 92 are available for connecting these separate printed circuit boards (not shown).

In light of the above, it will be appreciated by the skilled artisan that various connector configurations are possible for purposes of the present invention. For each embodiment, however, the particular contacts (e.g., contacts 20, 66, 72 and 84) are flexible members which can be bent or preformed to create a biased force which urges the respective end points into contact with an associated printed circuit board. Specifically, it is preferable that this force be approximately eighty (80) grams when a printed circuit board is operatively associated with a particular connector using a gold plated contact. It a tin plated contact is used, a force of approximately one hundred fifty (150) grams may be required. This is so in order to insure there is low interface resistance between the respective contact in the connector and the pad on the printed circuit board. Additionally, it is to be understood that each contact is to be electrically isolated from an adjacent contact. Although the above disclosure has referred to independent insulators (i.e., insulators 24 and 68), it will be understood that the individual contacts can be laminated or coated with a dielectric such as Kapton manufactured by Du Pont, to obtain the necessary electrical isolation between the contacts.

While the particular high density stacking connector as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. An electrical connector for interconnecting printed boards which have a plurality of electrical pads each distanced from another by at least twenty-five thousandths (0.025) of an inch, which comprises:

a base formed with a cavity;

a plurality of electrically conductive contacts, each having a spring-like body portion interconnecting a respective first end point and a respective second end point, said body portion having two cantilevers joined by a bent support portion, said end points being respectively formed on said cantilevers to enable said end points to move relative to each other, each of said body portions establishing a single path for electrical conductivity between respective said end points, said contacts positionable in said cavity with said first end points aligned together and said second end points aligned together in a substantially parallel relationship to said first end points, each of said contacts having a thickness less than ten thousandths (0.010) of an inch; and a plurality of insulators each separately interposed between each of said contacts to electrically isolate each of said contacts, each of said insulators having a thickness less than ten thousandths (0.010) of an inch.

2. An electrical connector as recited in claim 1 wherein each of said contacts is elongated and is flexible to permit relative movement between said first end point and said second end point.

3. An electrical connector as recited in claim 1 wherein said first end point and said second end point of each of said contacts positioned in said recess are movable between a disengaged position wherein said contact is unstressed and an engaged position wherein said contact is stressed to urge first end point and second end point toward their respective disengaged position.

4. An electrical connector as recited in claim 3 wherein each of said contacts is substantially W-shaped.

5. An electrical connector as recited in claim 3 wherein each of said contacts is substantially L-shaped.

6. An electrical connector as recited in claim 1 wherein said contact is made of a copper alloy.

7. An electrical connector as recited in claim 1 wherein said insulator is made of plastic.

8. An electrical connector as recited in claim 1 wherein said base is made of plastic.

9. An electrical connector for interconnecting printed boards which have a plurality of electrical pads each distanced from another by at least twenty-five thousandths (0.025) of an inch, which comprises:

a plurality of transmission units, each of said units having an electrically conductive contact formed with a flexible body portion terminating in a first end point and a second end point, said body portion having two cantilevers joined by a bent support portion, said end points being respectively formed on said cantilevers to enable said end points to move relative to each other, each of said body portions establishing a single path for electrical conductivity between respective said end points, each of said units having an insulator separately interposed between each of said contacts to electrically isolate each of said contacts, each of said units having an approximate thickness less than twenty thousandths (0.020) of one inch; and means for holding each of said plurality of electrically isolated transmission units in juxtaposition with other of said transmission units, with said first end points aligned, and said second end points aligned in a substantially parallel relationship with said first end points.

10. An electrical connector as recited in claim 9 wherein each of said transmission units comprises a said insulator laminated onto a said contact.

11. An electrical connector as recited in claim 9 wherein said first end point and said second end point of each of said contacts are movable between a disengaged position wherein said contact is unstressed and an engaged position wherein said contact is stressed to urge first end point and second end point toward their respective disengaged position.

12. An electrical connector as recited in claim 11 wherein each of said contacts is substantially W-shaped.

13. An electrical connector as recited in claim 11 wherein each of said contacts is substantially L-shaped.

14. An electrical connector which comprises:

a plurality of electrically conductive contacts, each of said contacts having a flexible body portion terminating in a respective first end point and a respective second end point, said body portion having two cantilevers joined by a bent support portion, said end points being respectively formed on said cantilevers to enable said end points to move relative to each other, each of said body portions establishing a single path for electrical conductivity between respective said end points, each of said contacts having a thickness less than ten thousandths (0.010) of an inch;

a plurality of insulators each separately associated with a respective contact to establish a strip wherein said first end points of said contacts are aligned and said second end points of said contacts are aligned in a substantially parallel relationship with said first end points, each of said insulators having a thickness less than ten thousandths (0.010) of an inch; and a base for holding said strip.

15. An electrical connector as recited in claim 14 wherein each of said contacts is elongated and is flexible to permit relative movement between said first end point and said second end point.

16. An electrical connector as recited in claim 14 wherein said first end point and said second end point of each of said contacts are movable between a disengaged position wherein said contact is unstressed and an engaged position wherein said contact is stressed to urge first end point and second end point toward their respective disengaged position.

17. An electrical connector as recited in claim 16 wherein each of said contacts is substantially W-shaped.

18. An electrical connector as recited in claim 16 wherein each of said contacts is substantially L-shaped.

19. An electrical connector as recited in claim 14 wherein said contact is made of a copper alloy, and wherein said insulator and said base are made of plastic.

20. An electrical connector for interconnecting a first printed circuit board with a second printed circuit board, each board having at least one electrical pad, which comprises:

a base formed with a cavity;

a plurality of electrically conductive contacts, each having a flexible body portion terminating in a first end point and a second end point, said body portion having two cantilevers joined by a bent support portion, said end points being respectively formed on said cantilevers to enable said end points to move relative to each other, each of said body portions establishing a single path for electrical conductivity between respective said end points, said contacts positionable in said cavity with said first end points aligned together for urging against said first printed circuit board with at least one end point touching each pad on said first printed circuit board, and said second end points aligned together substantially parallel to said first end points for urging against said second printed circuit board with at least one end point touching each pad on said second printed circuit board; and a plurality of electrical insulators each separately interposed between each of said contacts to electrically isolate each of said contacts.

* * * * *